US010167641B2

(12) United States Patent
Kinne et al.

(10) Patent No.: US 10,167,641 B2
(45) **Date of Patent: *Jan. 1, 2019**

(54) AIR CONTROL TRIGGER FOR INTEGRATED HANDHELD TEXTURE SPRAYER

(71) Applicant: Graco Minnesota Inc., Minneapolis, MN (US)

(72) Inventors: Robert W. Kinne, Columbia Heights, MN (US); Bret A. Deneson, Otsego, MN (US); Eric J. Finstad, Rogers, MN (US); Jeromy D. Horning, Albertville, MN (US)

(73) Assignee: Graco Minnesota, Inc., Minneapolis, MN (US)

( * ) Notice: Subject to any disclaimer, the term of this patent is extended or adjusted under 35 U.S.C. 154(b) by 158 days.

This patent is subject to a terminal disclaimer.

(21) Appl. No.: 14/761,465

(22) PCT Filed: Jan. 24, 2014

(86) PCT No.: PCT/US2014/012963

§ 371 (c)(1),
(2) Date: Jul. 16, 2015

(87) PCT Pub. No.: WO2014/116957

PCT Pub. Date: Jul. 31, 2014

(65) Prior Publication Data

US 2015/0322681 A1 Nov. 12, 2015

Related U.S. Application Data

(60) Provisional application No. 61/756,110, filed on Jan. 24, 2013.

(51) Int. Cl.
*E04F 21/12* (2006.01)
*B05B 7/12* (2006.01)
(Continued)

(52) U.S. Cl.
CPC ..... *E04F 21/12* (2013.01); *B05B 7/2408* (2013.01); *B05B 7/2416* (2013.01);
(Continued)

(58) Field of Classification Search
CPC ..... E04F 21/12; B05B 7/12; B05B 7/1413; B05B 7/2408; B05B 7/2416; B05B 7/2432; B05B 7/2478
(Continued)

(56) References Cited

U.S. PATENT DOCUMENTS 1,998,592 A 4/1935 Schenk
2,064,125 A 12/1936 Norris
(Continued)

FOREIGN PATENT DOCUMENTS

CN 1706557 A 12/2005
CN 101326012 A 12/2008

OTHER PUBLICATIONS

International Search Report and Written Opinion from PCT Application Serial No. PCT/US2014/012963, dated Oct. 27, 2014, 12 pages.

(Continued)

*Primary Examiner* — Chee-Chong Lee
(74) *Attorney, Agent, or Firm* — Kinney & Lange, P.A.

(57) ABSTRACT

A handheld sprayer comprises a housing, a turbine, a spray tip, a hopper and a trigger. An air flow passage extends through the housing. The turbine is configured to generate an airflow within the air flow passage. The spray tip is positioned to receive airflow from the air flow passage. The hopper is connected to the housing and is configured to discharge a fluid into the air flow passage. The trigger is mounted to the housing to control discharge of the hopper into the flow passage and airflow form the turbine. In different embodiments, the trigger controls airflow from the
(Continued)

turbine to the spray tip or the hopper or both. Additionally, a method for spraying a fluid from a handheld sprayer comprises controlling airflow from a turbine and discharge from a hopper into a passage using a combined actuator.

13 Claims, 5 Drawing Sheets

(51) Int. Cl.
*B05B 7/24* (2006.01)
*E04F 21/08* (2006.01)

(52) U.S. Cl.
CPC ..... *B05B 7/2432* (2013.01); *B05B 7/2478* (2013.01); *E04F 21/08* (2013.01)

(58) Field of Classification Search
USPC ..... 239/8
See application file for complete search history.

(56) References Cited

U.S. PATENT DOCUMENTS 2,413,710 A 1/1947 Jason
2,736,606 A 2/1956 Kmiotek
3,157,360 A 11/1964 Heard
3,263,927 A 8/1966 Johnson
4,411,387 A 10/1983 Stern et al.
4,961,537 A * 10/1990 Stern ..... B05B 7/2435 239/348
4,978,072 A * 12/1990 Kurowski ..... B05B 7/2413 239/346
5,037,011 A * 8/1991 Woods ..... B65D 83/752 222/394
5,119,993 A * 6/1992 Gunzel, Jr. ..... A01C 15/02 239/600
5,139,357 A * 8/1992 Reents ..... B05C 17/002 200/81 H
5,188,263 A * 2/1993 Woods ..... B65D 83/752 222/394
5,190,225 A * 3/1993 Williams ..... A01C 15/04 239/154
5,415,351 A 5/1995 Otto et al.
5,433,646 A 7/1995 Tarng
5,915,627 A 6/1999 Plasko
5,979,797 A 11/1999 Castellano
6,386,845 B1 5/2002 Bedard
7,374,111 B2 5/2008 Joseph et al.
7,731,104 B2 6/2010 Peterson et al.
7,762,476 B2 7/2010 Micheli
7,861,950 B2 1/2011 Rossner et al.
7,997,511 B2 8/2011 Reynolds et al.
8,210,449 B2 7/2012 Peterson et al.
2004/0089742 A1 5/2004 Antonucci
2005/0269425 A1 12/2005 Gohring et al.
2009/0008473 A1* 1/2009 Yun ..... A01M 7/0021 239/85
2009/0050709 A1* 2/2009 Rauch ..... B05B 7/1404 239/124
2009/0303831 A1 12/2009 Allen et al.
2010/0090019 A1 4/2010 Peterson et al.
2010/0206903 A1 8/2010 Banco et al.
2012/0181345 A1 7/2012 Mueller

OTHER PUBLICATIONS

Taiwan Office Action for Taiwanese Application No. 103102782, dated Mar. 9, 2017, 12 pages.
Second Taiwanese Office Action, for Taiwanese Patent Application No. 103102782, dated Dec. 12, 2017, 15 pages.

* cited by examiner

AIR CONTROL TRIGGER FOR INTEGRATED HANDHELD TEXTURE SPRAYER

BACKGROUND

The present invention is related to handheld sprayers, and in particular to systems and methods for controlling airflow for integrated handheld sprayers.

Handheld texture sprayers are utilized, for example, to apply coatings to walls, ceilings, and/or other surfaces. These coatings may include, for example, "knockdown" finishes, "popcorn" finishes, and fine "orange peel" finishes. Texture sprayers are supplied a viscous material, such as, for example, drywall mud from a separate tank or an attached hopper. An airflow provided to the sprayer atomizes the fluid into a spray that is applied to a surface in order to create a desired finish.

In the past, the airflow has been provided from, for example, an external air compressor. These air compressors are often bulky and limit the mobility and convenience of the texture sprayer. To provide portability, these external air compressors have been replaced with a local airflow source, such as a turbine. One such portable texture sprayer is disclosed in U.S. Pat. No. 7,731,104. While providing portability, these texture sprayers lack the control desirable for providing specific and quality texture finishes. These texture sprayers are limited in both the type and quality of finish they can provide. It is desirable to provide improved control for handheld sprayers in order to provide a greater range and greater quality of the finishes created by the sprayer.

SUMMARY

A handheld sprayer comprises a housing, a turbine, a spray tip, a hopper and a trigger. An air flow passage extends through the housing. The turbine is configured to generate an airflow within the air flow passage. The spray tip is positioned to receive airflow from the air flow passage. The hopper is connected to the housing and is configured to discharge a fluid into the air flow passage. The trigger is mounted to the housing to control discharge of the hopper into the flow passage and airflow from the turbine. In different embodiments, the trigger controls airflow from the turbine to the spray tip or the hopper or both.

A method for spraying a fluid from a handheld sprayer comprises generating an airflow with a turbine, directing the airflow through a passage within the sprayer to a spray tip, selectively discharging a fluid into the passage from a hopper for spraying through the spray tip, and controlling airflow from the turbine using a combined actuator that also controls discharge of the hopper into the passage.

DETAILED DESCRIPTION

Disclosed herein is a handheld texture sprayer that includes a combined actuator for controlling flow of air from a turbine and flow of fluid from a hopper into a flow passage. The handheld texture sprayer includes a housing, a turbine, a spray tip, and a hopper. An air flow passage extends through the housing and carries an airflow generated by the turbine. The hopper is connected to the housing and holds fluid that is provided to the airflow passage for spraying. The sprayed fluid is projected through the spray tip for application to a surface. In one embodiment, the combined actuator controls airflow from the turbine to the spray tip. In another embodiment, a bleed line connects an output of the turbine to the hopper, the hopper includes a sealable lid, and the combined actuator controls airflow from the turbine to the hopper to pressurize the hopper.

Figure 1:
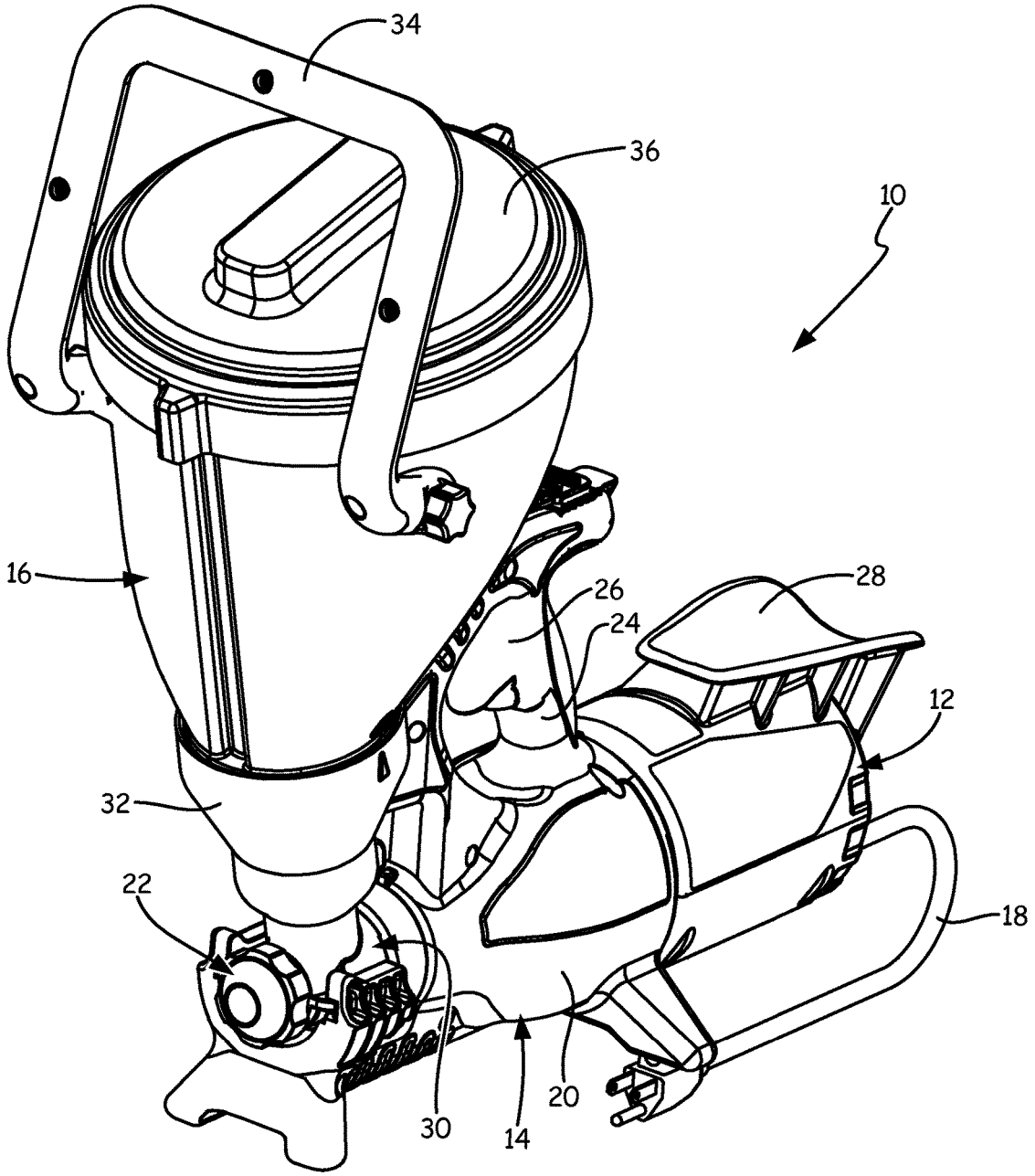
FIG. 1 is a perspective view of an integrated handheld texture sprayer having a turbine, a dispenser and a hopper.

FIG. 1 is a perspective view of integrated handheld texture sprayer 10 having turbine 12, dispenser 14 and hopper 16. In the described embodiments, sprayer 10 may be used to dispense a fluid having a texturizing additive, which is present in hopper 16. Dispenser 14 utilizes an airflow generated by turbine 12 to discharge the fluid in a spray pattern conducive for forming texturized finishes.

Turbine 12 utilizes electrical power from cord 18 to generate a flow of compressed air for pushing liquid from hopper 16 through dispenser 14. Turbine 12 is inserted into housing 20 of dispenser 14 to fluidly interact with spray tip 22. Housing 20 includes handle 24 into which is integrated trigger 26. An operator of sprayer 10 grasps handle 24 with a hand while resting a forearm on pad 28 so that trigger 26 can be actuated with one or more fingers. Turbine 12 is activated via a power switch (FIG. 3) in order to produce the pressurized air via rotation of an impeller, fan or the like. Upon actuation of trigger 26, a valve behind spray tip 22 is opened that simultaneously allows fluid from hopper 16 to enter mix chamber 30 through funnel 32, and air from turbine 12 to enter mix chamber 30 through housing 20. Spray tip 22 is interchangeable so that different patterns can be sprayed. For texture sprayers, spray tip 22 includes an opening sufficiently large to discharge fluid and texturizing particles. Hopper 16 also includes handle 34 and lid 36 so that sprayer 10 can be easily grasped to orientate spray tip 22 upward without fluid overflowing from hopper 16.

Figure 2:
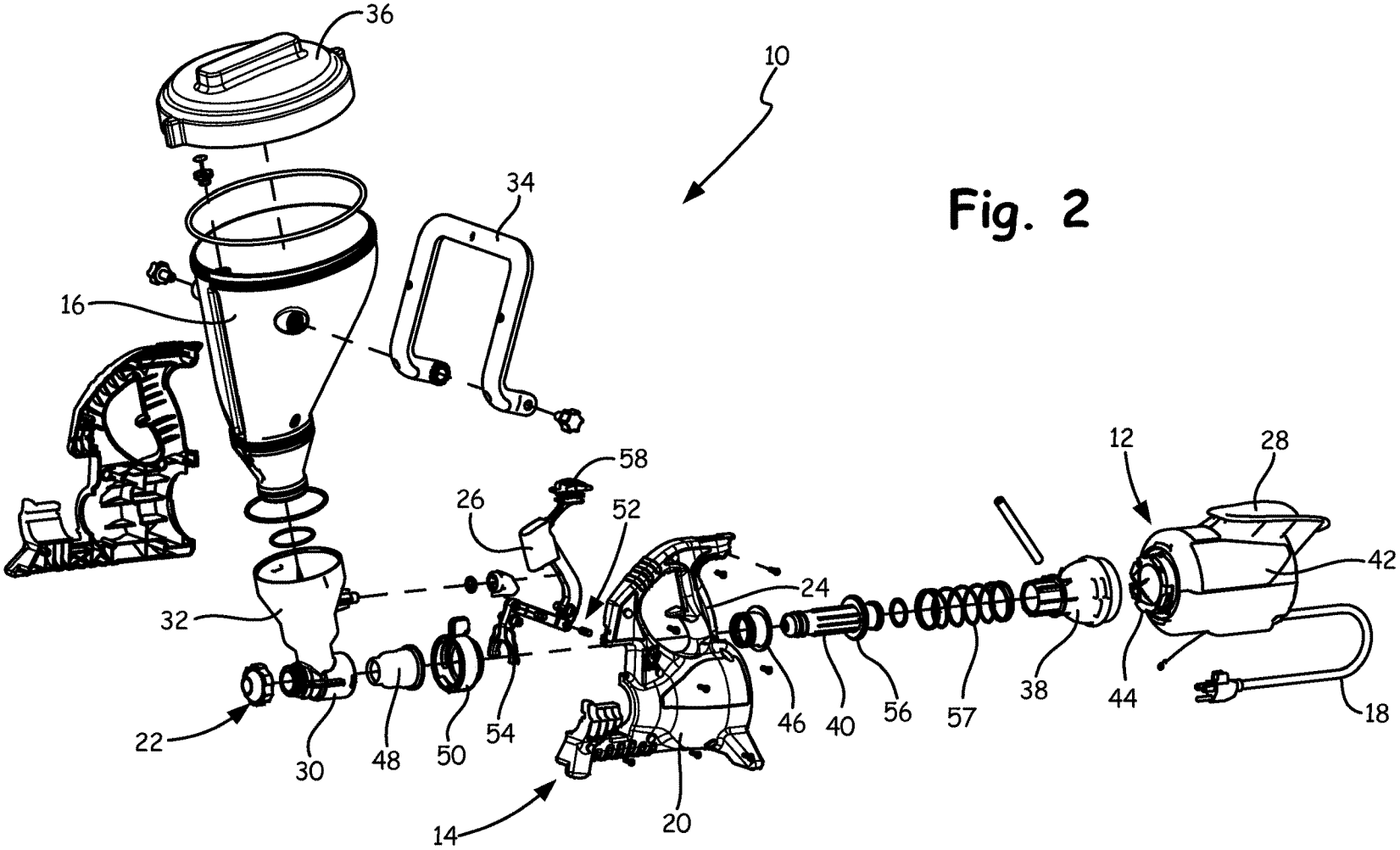
FIG. 2 is an exploded view of the texture sprayer of FIG. 1 showing an air flow path from the turbine, through a plenum and piston within the dispenser and to a spray tip.
Figure 3:
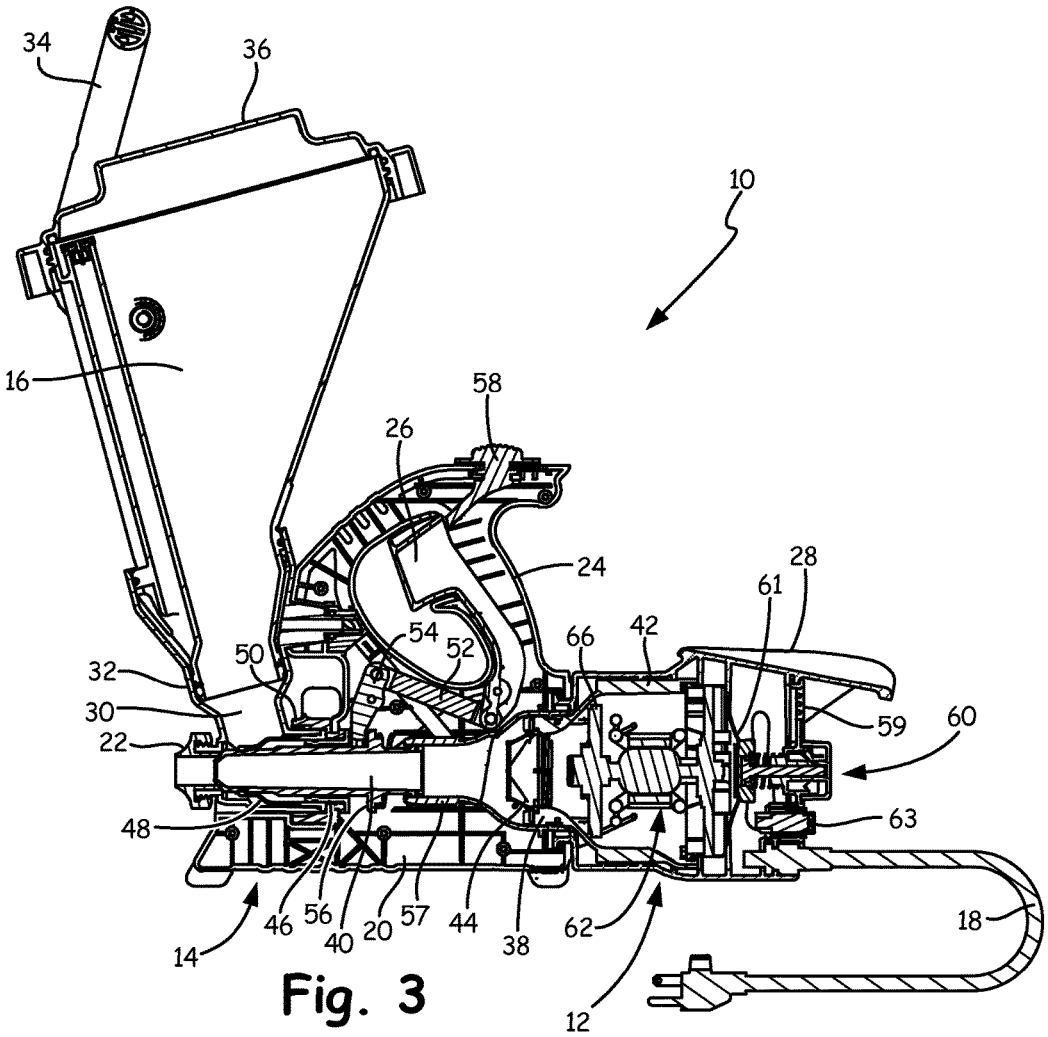
FIG. 3 is cross-sectional view of the texture sprayer of FIG. 2 showing interconnection of the turbine, a trigger, the piston and the spray tip.

FIG. 2 is an exploded view of texture sprayer 10 of FIG. 1 showing an air flow path from turbine 12, through plenum 38 and piston 40 within dispenser 14, to spray tip 22. Plenum 38 connects to housing 42 of turbine 12 to receive pressurized air from outlet 44. Piston 40 is slidable between plenum 38 and spray tip 22. Piston 40 is supported within housing 20 and mix chamber 30 via bushing 46 and sleeve 48. Collar 50 couples mix chamber 30 to housing 20, with bushing 46 and sleeve 48 being retained between via flanges (as can be seen in FIG. 3). Spray tip 22 is threaded onto an outlet opening in mix chamber 30. Trigger 26 is coupled to piston 40 via linkage 52 and yoke 54, which engages flange 56 on piston 40. Spring 57 is positioned around portions of plenum 38 and piston 40. Trigger lock 58 is slidable within housing 20 above handle 24 to limit movement of trigger 26.

As will be discussed in more detail with reference to FIG. 3, turbine 12 generates an airflow that passes from turbine exit 44 into plenum 38, which directs the airflow into piston 40 that extends through housing 20 to spray tip 22. Piston 40 is biased toward spray tip 22 via spring 57 to prevent fluid within hopper 16 from entering mix chamber 30 without actuation of trigger 26. Retraction of trigger 26 into handle 24 pulls piston 40 away from spray tip 22 via interaction of linkage 52 and yoke 54 with flange 56. Fluid stored within hopper 16 is allowed to drop, or otherwise flow, into mix chamber 30 and, with piston 40 disengaged from spray tip 22, the fluid is forced into and out of spray tip 22 by the passage of air from piston 40 to spray tip 22.

FIG. 3 is cross-sectional view of texture sprayer 10 of FIG. 2 showing interconnection of turbine 12, plenum 38, piston 40, trigger 26 and spray tip 22. Air is permitted into housing 20 of sprayer 10 via inlet vent 59. In the embodiment shown, flow of air from inlet vent 59 into turbine inlet 61 of turbine 12 is controlled with airflow control 60. Motor 62 is disposed within housing 20 between turbine inlet 61 and plenum 38. Motor 62 may comprise any suitable AC or DC magneto-electric machine that produces rotational output. Thus, activation of motor 62 causes fan 66 to draw air through inlet vent 59 and turbine inlet 61. Motor 62 is activated by switch 63, which may comprise a rocker switch that allows power from cord 18 to motor 62. Thus, motor 62 and turbine 12 provide a continuous flow of air through sprayer 12 so long a switch 63 is activated.

Turbine 12 pushes air into plenum 38 at turbine outlet 44. Piston 40 guides air from plenum 40 to spray tip 22. Spray tip 22 and piston 40 operate as a valve to control flow of fluid from hopper 16 into spray tip 22. Spray tip 22 and piston seal against each other when engaged in a closed position to prevent air from being in fluid communication with mix chamber 30. Spring 57 pushes between flange 56 and plenum 38 to bias piston 40 to the closed position. In order to move piston 40 to an open position, trigger 26 is translated, such as by an operator of sprayer 10, away from spray tip 22 (to the right in FIG. 3). Linkage 52 pulls yoke 54 to push flange 56 and piston 40 to an open position away from spray tip 22 such that mix chamber 30 is put into fluid communication with airflow from piston 40.

Moving piston 40 from the closed position to the open position opens the valve formed by spray tip 22 and piston 40, and allows fluid from within hopper 16 that is present within mix chamber 30 to enter the air flow path between spray tip 22 and piston 40. In one embodiment, the fluid is pushed into the air flow path primarily via gravity. Additionally, the flow of compressed air between piston 40 and spray tip 22 generates a slight vacuum that pulls in fluid from hopper 16. As such, the flow of air through piston 40 pulls the fluid along through spray tip 22.

The pattern of the sprayed fluid can be adjusted by changing the amount that trigger 26 is actuated. Retracting trigger 26 further into handle 24 allows for more fluid to enter spray tip 22, thereby resulting in a more dense spray pattern. Trigger lock 58 is adjustable to limit the movement of trigger 26. For example, trigger lock 58 can be locked into different positions along the top of handle 24 to provide a barrier to translation of trigger 26 into handle 24. Trigger lock 58 is provided on handle 24 in a location convenient for an operator of sprayer 12 to access, such as with a thumb. Furthermore, the spray pattern can be adjusted by swapping out spray tip 22 for other spray tips having different sized openings that will widen or narrow the pattern of discharged fluid from sprayer 10.

Integrated handheld texture sprayer 10 of the present invention may include other features not described above or that elaborate on the features described above. For example, the present invention is directed to a combined actuator that simultaneously controls flow of air from turbine 12 and flow of fluid from hopper 16 into the flow passage of sprayer 12. In one embodiment, the combined actuator controls airflow from turbine 12 to spray tip 22. In another embodiment, the combined actuator controls airflow from turbine 12 to hopper 16 in order to pressurize hopper 16.

Figure 4:
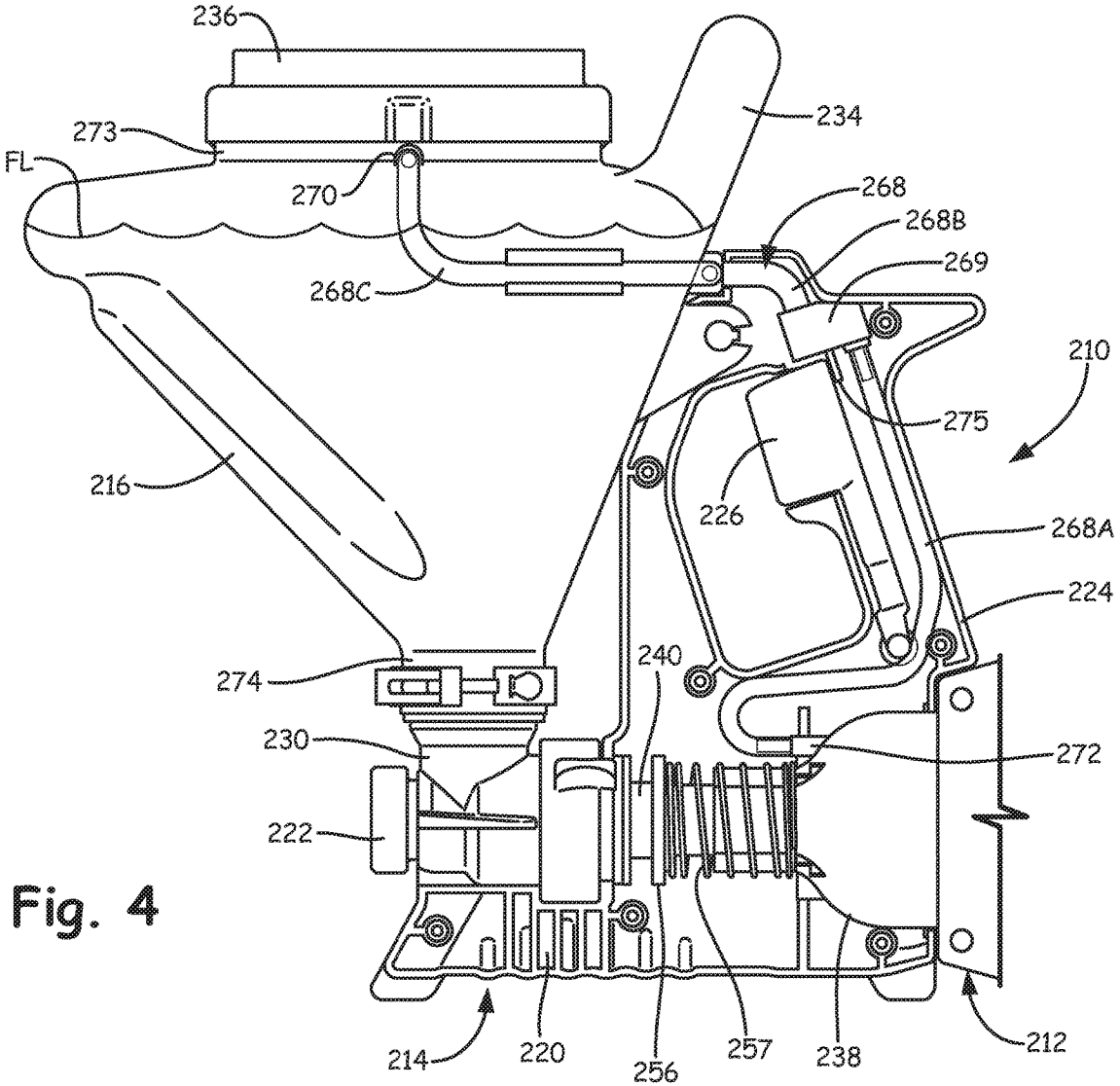
FIG. 4 is a cross-sectional view of an alternative embodiment of the texture sprayer of FIG. 3 including a pressure-assist hopper that is trigger-actuated.

FIG. 4 is a cross-sectional view of an alternative embodiment of the texture sprayer 10 of FIG. 3 in which texture sprayer 210 includes pressure-assist hopper 216 that is trigger-actuated. Texture sprayer 210 includes similar components as texture sprayer 10 of FIG. 3, which are labeled with 200-series numerals. Texture sprayer 210 additionally includes bleed line 268 extending between hopper fitting 270 and plenum fitting 272. Bleed valve 269 is positioned in bleed line 268 between fitting 272 and fitting 270. Hopper 216 also includes flange 273, to which lid 236 is mounted and from which hopper fitting 270 extends, and outlet 274, which connects to housing 220 at mix chamber 230.

Turbine 212 provides compressed air to plenum 238, which, through piston 240, feeds spray tip 222. Spring 257 engages flange 256 to bias piston 240 toward spray tip 222. Trigger 226 can be actuated to pull piston 240 away from spray tip 222 via a linkage (not shown) that engages flange 256. Thus, any fluid disposed within mix chamber 230 will be forced through spray tip 222 when piston 240 retracts while turbine 212 is operating. In order to assist with flow of fluid from hopper 216 to spray tip 222, sprayer 210 is provided with an air-assist mechanism that pressurizes the interior of hopper 216.

When powered, turbine 212 continuously provides compressed air to spray tip 222. Bleed line 268 is configured to redirect a portion of the compressed air from plenum 238 to the interior of hopper 216. In one embodiment, bleed line 268 comprises a plurality of segments 268A, 268B and 268C, which may be fabricated from flexible tube or hose, that extends between hopper fitting 270 and plenum fitting 272. Fitting 272 provides a tap-off point from plenum 238 that supplies bleed line 268A with compressed air from turbine 212. In one embodiment, fitting 272 comprises a cylindrical extension from plenum 238 around which bleed line 268 is fitted. Fitting 270 provides a feed point into hopper 216 that receives compressed air from bleed line 268C. In one embodiment, fitting 270 comprises a cylindrical extension from hopper 216 around which bleed line 268 is fitted. In various embodiments, fittings 270 and 272 may be provided with barbs or the like to inhibit dislodgment of bleed line 268 from the fittings.

Bleed line 268B connects bleed line 268A and bleed line 268C using valve 269. Bleed line 268B connects to bleed line 268C through a fitting that allows feed line 268 to extend out of housing 220. Valve 269 directly connects bleed line 268B and bleed line 268A. As such, valve 269 may have fittings or other such fluid couplings to connect with tubes or hoses. Valve 269 is positioned to mechanically engage with trigger 226. Valve 269 can be actuated to open and close airflow through bleed line 268. Specifically, in one embodiment, when trigger 226 is pulled back to allow air from turbine 212 to spray tip 222, valve 269 is also opened.

Compressed air from bleed line 268 is directed into an upper portion of hopper 216 near lid 236. In the depicted embodiment, fitting 270 penetrates into hopper 216 at flange 272. Lid 236 is configured to mate with flange 272 to seal liquid within hopper 216. Lid 236 may be joined to flange 272 via any suitable means, such as a snap fitting or a threaded connection. Compressed air introduced into hopper 216 enters between lid 236 and fluid line FL, thereby pressurizing the interior of hopper 216 and forcing the fluid toward outlet 274 and mix chamber 230.

Pressurization of hopper 216 results in higher and more consistent flow rates between hopper 216 and mix chamber 230. Additionally, the pressurization reduces the potential for pack out, wherein mix chamber 230 becomes clogged with texture material added to the fluid of hopper 216. Pressurization of hopper 216 thus enables spraying of a larger array of materials, with different finishes, textures, mixture rates and viscosities. Additionally, the presence of lid 236, which facilitates generation of the pressurized hopper, also allows for sprayer 210 to be utilized in a wider array of orientations without spilling fluid from hopper 216. The use of an external air supply is eliminated due to the presence of integrated turbine 212.

Bleed valve 269 is positioned in bleed line 268 between fitting 272 and fitting 270. Bleed valve 269 comprises an adjustable valve that can restrict the flow of compressed air bled at fitting 272. For example, bleed valve 269 includes lever 275 that can be actuated as trigger 226 is displaced into handle 224. Lever 275 can be displaced to open and close airflow through bleed line 268. In a fully open position, valve 269 may provide no restriction of airflow. In a fully closed position, valve 269 may close-off all airflow through bleed line 168. Bleed valve 269 can be manually set with trigger 226 to any intermediate position between fully open and fully closed as trigger 226 is actuated. Thus, valve 269 can be used to provide a desired amount of pressurization to hopper 216, based on the amount of pressurized air provided by turbine 212. Bleed valve 269 may comprise any suitable valve as is known in the art.

As described, trigger 226 simultaneously controls valve 269 and the valve formed at the interaction of piston 240 and spray tip 222. Thus, trigger 226 comprises a combined actuator for both the flow of bleed air through bleed line 268 and the flow of fluid from hopper 216. Combining airflow and fluid flow increases the ease of operation for an operator of sprayer 210. Separate adjustments of fluid flow and airflow are avoided and an operator can focus on actuation of only a single control, trigger 226. Thus, better control over the spray pattern from spray tip 222 can be achieved. Furthermore, in other embodiments, valve 269 can be selected to have discharge settings specific for different texture finishes. For example, valve 269 can be set to limit or restrict airflow through bleed line 268 from what might otherwise be available from the bleed point at fitting 272, such as for fluids having low viscosity.

Figure 5:
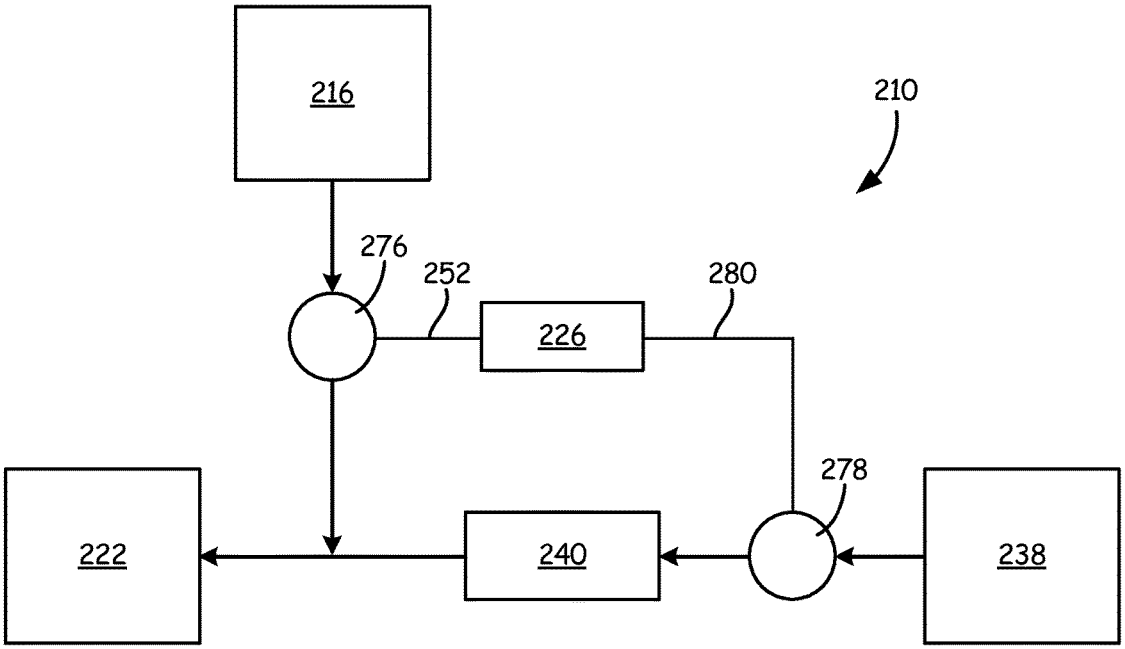
FIG. 5 is a schematic of an alternative embodiment of the texture sprayer of FIG. 4 in which the trigger controls airflow through the sprayer.

FIG. 5 is a schematic of an alternative embodiment of texture sprayer 210 of FIG. 4 in which trigger 226 controls airflow between plenum 238 and spray tip 222, in addition to controlling fluid flow between hopper 216 and spray tip 222. Trigger 226 controls valve 276, which schematically represents the interaction between piston 240 and spray tip 222. Trigger 226 also controls valve 278 which can be positioned in the air flow passage between turbine 212 (FIG. 4) and spray tip 222.

Sprayer 210 of FIG. 5 operates in the same manner as that of the sprayer described with reference to FIG. 4. For example, linkage 252 is displaced by trigger 226 to move piston 240 via a yoke. However, bleed line 268 and valve 269 are omitted in FIG. 5, and valve 278 is added. In other embodiments, bleed lined 268 and valve 269 may be used in conjunction with valve 278. Valve 278 is actuated by trigger 226 through operation of linkage 280.

Valve 278 comprises an adjustable valve that can restrict the flow of compressed air from turbine 212 (FIG. 4). Thus, valve 278 may be positioned within plenum 238 or piston 240. Bleed valve 278 may comprise any suitable valve as is known in the art that can be mechanically actuated by trigger 226. For example, valve 278 may include a lever (like lever 275 (FIG. 4) of valve 269) that can be actuated as trigger 226 is displaced into handle 224 (FIG. 4). In a fully open position, valve 278 may provide no restriction of airflow. In a fully closed position, valve 278 may close-off all airflow through piston 240. Valve 278 can be manually set with trigger 226 to any intermediate position between fully open and fully closed as trigger 226 is actuated.

Control of airflow from turbine 212 to spray tip 222 is desirable to allow for better control of texture finishes created by texture sprayer 210. For example, less airflow may be desirable for creating heavy "knockdown" finishes while greater airflow may be desirable for creating fine "orange peel" finishes. Thus, the amount of airflow through valve 278 dictates the texture finish created by the spray produced through spray tip 222. By controlling the airflow from turbine 212 to spray tip 222 while simultaneously controlling fluid flow from hopper 216, better control of the texture finish produced by texture sprayer 210 is accomplished.

Although the present invention has been described with reference to preferred embodiments, workers skilled in the art will recognize that changes may be made in form and detail without departing from the spirit and scope of the invention.

The invention claimed is:

1. A handheld sprayer comprising:

a housing through which an air flow passage extends;

a compressed air source configured to generate an airflow within the air flow passage;

a spray tip positioned to receive airflow from the air flow passage;

a hopper connected to the housing and configured to discharge a fluid into the air flow passage a first valve that modulates air flow within the air flow passage;

a bleed line extending between an outlet of the compressed air source and the hopper;

a trigger mounted to the housing;

a second valve that is positioned in the bleed line and connected to the trigger, and that modulates bleed airflow to the hopper from the compressed air source;

wherein actuation of the trigger controls discharge of the fluid from the hopper into the air flow passage, controls the first valve to change the airflow within the air flow passage, and controls the second valve to change the bleed airflow within the bleed line;

wherein actuation of the trigger increases both the discharge of the fluid from the hopper into the air flow passage and the bleed airflow from the compressed air source to the hopper.

2. The handheld sprayer of claim 1 wherein the housing defines a mix chamber between the air flow passage and the spray tip, and wherein the hopper discharges the fluid into the mix chamber.

3. The handheld sprayer of claim 1 wherein the air flow passage comprises:

a plenum connected to the outlet of the compressed air source; and a piston extending from the plenum to the spray tip;

wherein the trigger is configured to retract the piston from the spray tip to allow fluid from the hopper into the air flow passage.

4. The handheld sprayer of claim 1 wherein the trigger controls airflow from the compressed air source to the spray tip.

5. The handheld sprayer of claim 1 wherein the bleed line extends through a handle in the housing into which the trigger is mounted.

6. The handheld sprayer of claim 1 wherein the hopper is pressurized by the bleed airflow directed into the hopper.

7. The handheld sprayer of claim 6 wherein the hopper comprises:

an outlet discharging into the housing;

an inlet opening;

a bleed line fitting disposed proximate the inlet opening; and a lid covering the inlet opening.

8. The handheld sprayer of claim 1 wherein the compressed air source is a turbine.

9. The handheld sprayer of claim 1, wherein the trigger mechanically engages the second valve.

10. A method for spraying a fluid from the handheld sprayer of claim 1, the method comprising:

generating an airflow with the compressed air source;

directing the airflow through the air flow passage within the sprayer to the spray tip;

selectively discharging the fluid into the air flow passage from the hopper for spraying through the spray tip; and controlling the airflow from the compressed air source using the trigger, the trigger also controlling discharge of the fluid from the hopper into the air flow passage.

11. The method of claim 10 wherein the trigger is mechanically coupled to a piston defining a portion of the air flow passage.

12. The method of claim 11 wherein the passage comprises:

a plenum connected to the outlet of the compressed air source; and the piston which extends from the plenum to the spray tip;

wherein the trigger is configured to retract the piston from the spray tip to allow fluid from the hopper into the air flow passage.

13. The method of claim 11 wherein the trigger is mechanically coupled to the second valve.

* * * * *